United States Patent [19]

Poynor et al.

[11] Patent Number: 4,514,282

[45] Date of Patent: Apr. 30, 1985

[54] HYDROGEN DONOR DILUENT CRACKING PROCESS

[75] Inventors: Paul C. Poynor; Joseph W. Burdett, both of Ponca City, Okla.

[73] Assignee: Conoca Inc., Ponca City, Okla.

[21] Appl. No.: 515,733

[22] Filed: Jul. 21, 1983

[51] Int. Cl.[3] ..... C10G 69/06

[52] U.S. Cl. ..... 208/56; 208/67; 208/89

[58] Field of Search ..... 208/56, 67, 68, 76, 208/89

[56] References Cited

U.S. PATENT DOCUMENTS

| | | | |
|---|---|---|---|
| 2,352,025 | 6/1944 | Seguy | 208/56 |
| 2,772,221 | 11/1956 | Stewart et al. | 208/56 |
| 2,953,513 | 9/1960 | Langer | 208/56 |
| 3,168,459 | 2/1965 | Anderson et al. | 208/57 |
| 3,407,134 | 10/1968 | Wunderlich et al. | 208/111 |
| 4,062,757 | 12/1977 | Beuther et al. | 208/61 |
| 4,115,246 | 9/1978 | Sweany | 208/56 |
| 4,294,686 | 10/1981 | Fisher et al. | 208/56 |
| 4,363,716 | 12/1982 | Greene et al. | 208/56 X |
| 4,430,197 | 2/1984 | Poynor et al. | 208/56 |
| 4,446,004 | 5/1984 | Chen et al. | 208/57 |
| 4,451,354 | 5/1984 | Stuntz | 208/56 |

FOREIGN PATENT DOCUMENTS

| | | | |
|---|---|---|---|
| 553169 | 2/1958 | Canada | 208/56 |
| 786451 | 7/1955 | United Kingdom | 208/56 |

*Primary Examiner*—Delbert E. Gantz
*Assistant Examiner*—O. Chaudhuri
*Attorney, Agent, or Firm*—Richard W. Collins

[57] ABSTRACT

Heavy hydrocarbonaceous oil is cracked by hydrogen donor diluent cracking, and pitch from the donor cracking step is recycled. The pitch is catalytically hydrotreated before it is recycled. Hydrotreating the pitch enables complete conversion of the 950° F.+ fraction of heavy hydrocarbonaceous oil to 950° F.− distillate.

8 Claims, 1 Drawing Figure

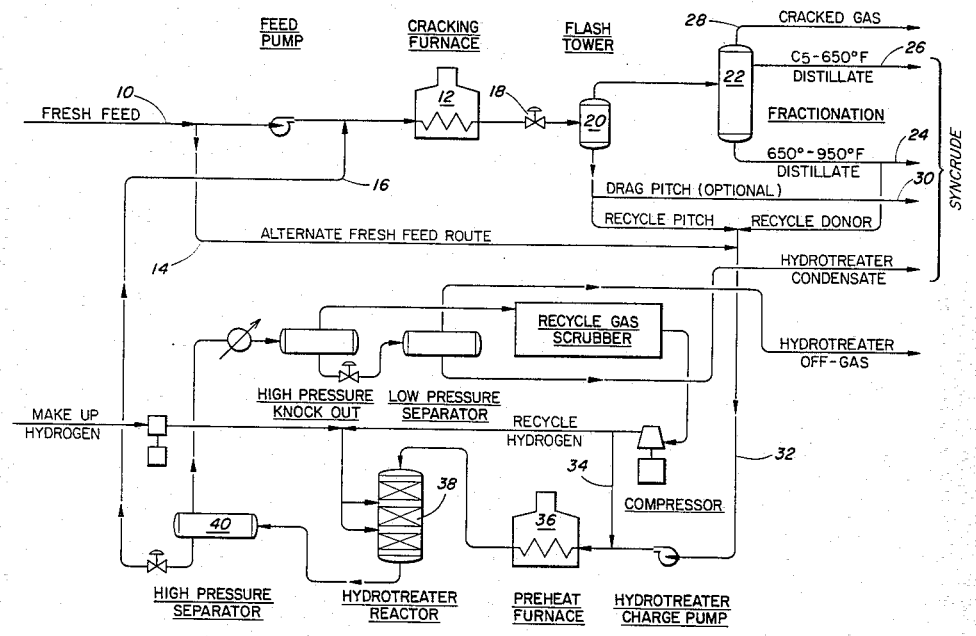

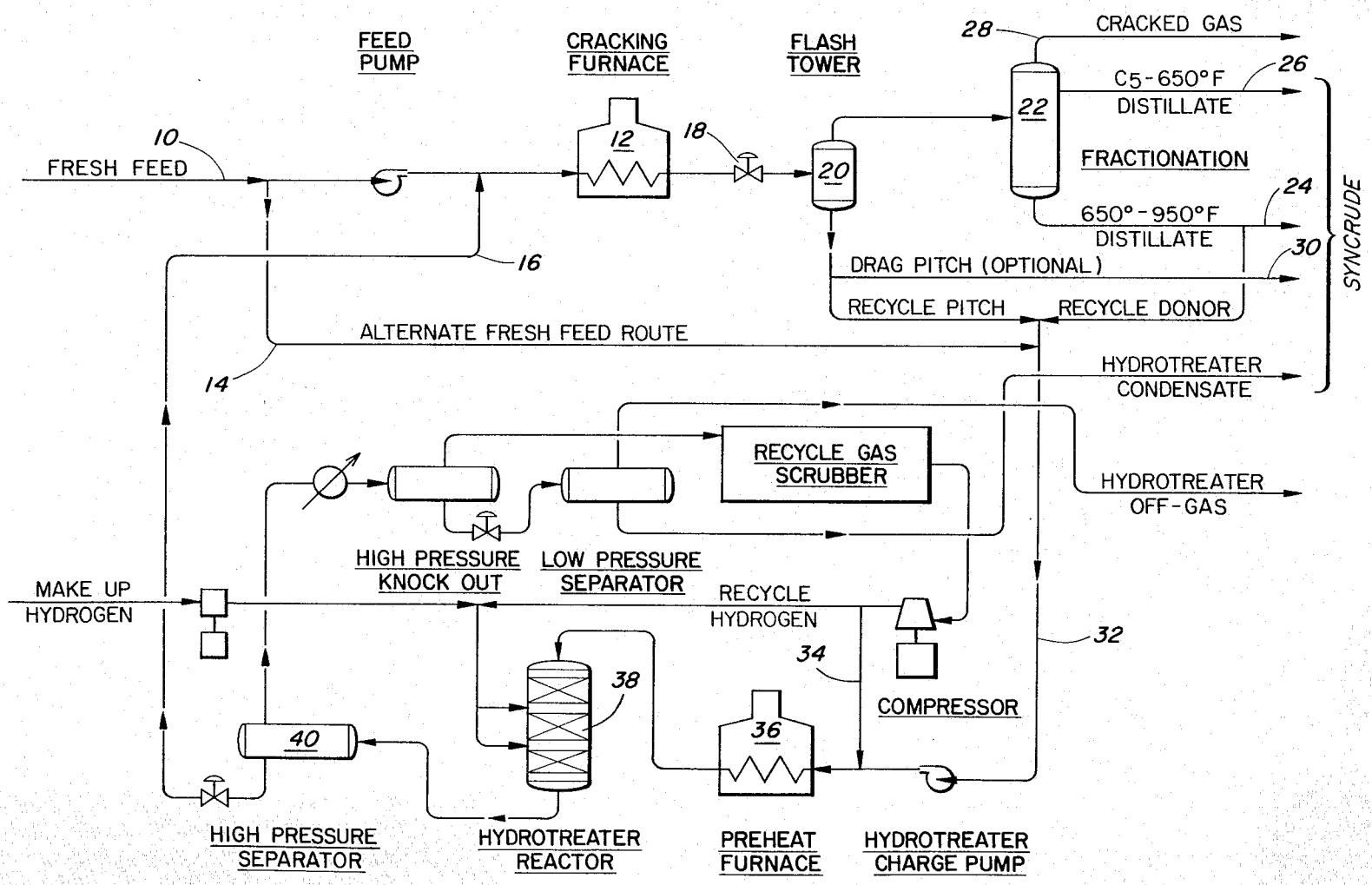
SYNCRUDE
CRACKED GAS
C5-650°F DISTILLATE
FRACTIONATION
650°-950°F DISTILLATE
DRAG PITCH (OPTIONAL)
RECYCLE DONOR
HYDROTREATER CONDENSATE
HYDROTREATER OFF-GAS
RECYCLE PITCH
FLASH TOWER
CRACKING FURNACE
FEED PUMP
FRESH FEED
ALTERNATE FRESH FEED ROUTE
RECYCLE GAS SCRUBBER
LOW PRESSURE SEPARATOR
HIGH PRESSURE KNOCK OUT
RECYCLE HYDROGEN
COMPRESSOR
MAKE UP HYDROGEN
HYDROTREATER CHARGE PUMP
PREHEAT FURNACE
HYDROTREATER REACTOR
HIGH PRESSURE SEPARATOR
10
12
14
16
18
20
22
24
26
28
30
32
34
36
38
40

HYDROGEN DONOR DILUENT CRACKING PROCESS

BACKGROUND OF THE INVENTION

1. Field of the Invention

This invention relates to a process for upgrading heavy hydrocarbonaceous oils, and more particularly to an improved hydrogen donor diluent cracking process.

2. Description of the Prior Art

The hydrogen donor diluent cracking process in which certain low value hydrocarbon fractions are upgraded by thermal cracking in the presence of a hydrogen donor diluent is described in detail in U.S. Pat. No. 2,953,513. Process variables and operating conditions for the hydrogen donor diluent cracking process are discussed at length in that patent. One disadvantage of the conventional hydrogen donor diluent cracking process is that fractionation of the product stream from the cracking step produces a heavy bottoms or pitch stream which is of low value relative to the other products from the process and in some cases presents a disposal problem. A portion of this heavy pitch material may be recycled through the process, but as a practical matter a substantial purge is usually required in order to operate the process continuously in an efficient manner. The process of the present invention overcomes the aforementioned disadvantage, and provides a more efficient process.

In U.S. Pat. No. 4,115,246 a process is described in which the pitch fraction resulting from fractional distillation of the products of a hydrogen donor diluent cracking step is subjected to a partial oxidation process, and the resulting hydrogen-containing gas produced by the partial oxidation step is utilized to hydrogenate the recycled hydrogen donor solvent. The pitch fraction is defined as the product of the fractional distillation boiling above 500° C. The fresh feedstock to the cracking furnace could be shale oil, tar sand bitumen, or residual oil from a petroleum refining operation.

U.S. Pat. Nos. 4,294,686 and 4,363,716 each disclose hydrogen donor diluent cracking processes in which part of the pitch fraction from the cracking step is recycled back to the cracking zone.

In U.S. patent application Ser. No. 365,721 filed Apr. 5, 1982 and assigned to the assignee of the present application, a hydrogen donor diluent cracking process is described in which the pitch fraction from the cracking step is heat-soaked with donor solvent and then returned to the cracking zone.

SUMMARY OF THE INVENTION

According to the present invention, the pitch fraction from a hydrogen donor diluent cracking process is catalytically hydrotreated and recycled to the cracking zone. Preferably, the entire pitch fraction is continuously hydrotreated and recycled such that the entire pitch fraction from the cracking step is eventually converted to distillate material.

It is an object of the present invention to increase the amount of distillate products from a hydrogen donor diluent cracking process.

THE DRAWINGS

The FIGURE is a schematic flow diagram illustrating the process of the invention.

PREFERRED EMBODIMENTS OF THE INVENTION

Heavy hydrocarbonaceous oils such as tar sand bitumen, shale oil, coal extracts and petroleum residual oils can be cracked by hydrogen donor diluent cracking (HDDC) to produce distillates. The remaining pitch contains all the original organic metals and Conradson carbon residue (CCR) precursors found in the original feed. Extensive recycling of the pitch increases conversion of nonvolatile oils and further concentrates the metals, but is does not result in the conversion of CCR precursors that is necessary for complete conversion of feed to distillate material.

As used herein, the term "distillate" includes the materials boiling below a selected point, such as 950° F., and the term "pitch" includes the materials which are not distillable at the selected point. In some instances the terms 950° F.− and 950° F.+ are used to designate distillate and pitch, but it will be appreciated that the cut point between distillate and pitch could vary somewhat from the 950° F. point selected herein.

The basic process in accordance with the preferred embodiment of the invention will be described generally by reference to the FIGURE.

Fresh feed from line 10 is pumped to cracking furnace 12. If the fresh feed is high in sulfur or Conradson carbon residue precursors, all or part of the fresh feed may be routed through line 14 for preliminary hydrotreating before it is cracked in furnace 12. Hydrogen donor solvent and hydrotreated recycle pitch from line 16 are combined with fresh feed and fed to cracking furnace 12 where part of the nonvolatile hydrocarbons are thermally cracked. The presence of the hydrogen donor solvent prevents coke formation in the furnace tubes. Typical cracking furnace conditions are an outlet temperature of 850°–1000° F., an outlet pressure of 400–700 psig and a cold oil residence time of one to six minutes.

Cracking furnace effluent is flashed across pressure control valve 18 into an atomospheric flash tower 20. Overhead material from flash tower 20 is fractionated in distillation tower 22, and a distillate fraction having a boiling range of 650°–950° F. is recovered from the bottom of distillation tower 22 for reuse as hydrogen donor solvent. Some donor solvent may be withdrawn as product through line 24. The remainder of the flash tower overhead material is recovered as a $C_5$-650° F. distillate through line 26 and as cracked gas through line 28. The cracked gas can be burned as fuel or further processed.

The pitch fraction from cracking furnace 12 is withdrawn from the bottom of flash tower 20. Part of this pitch may be recovered as product through line 30, and the remainder is combined with the 650°–950° F. distillate from distillation tower 22 and charged (optionally with part or all of the fresh feed) to the hydrotreating section.

In the hydrotreating section, recycle pitch, recycle donor and fresh feed may be combined in line 32, and the combined charge plus recycle hydrogen from line 34 are heated in preheat furnace 36 and passed down through hydrotreater reactor 38. Additional hydrogen may be added at intermediate points in the catalyst bed to reduce catalyst bed temperature. The recycle pitch, recycle donor and fresh feed preferably are hydrotreated in the same reactor, but each of these streams may be partially or totally hydrotreated in a separate reactor.

In the hydrotreater reactor, Conradson carbon precursors are hydrogenated to nonprecursors that can be cracked to distillate in the hydrogen donor cracking furnace, donor solvent is hydrotreated to its hydrogen-rich state, and organic metals are removed from the heavy oils by the catalyst material in the hydrotreater reactor. Additionally, the level of organic sulfur, oxygen and nitrogen in the heavy oils is reduced, olefinic hydrocarbons are saturated, and some of the 950° F.+ material is hydrocracked to 950° F.− distillate and light hydrocarbon gases.

Preferred hydrotreater reactor operating conditions include a temperature of from 650°–800° F., a pressure of 500 to 3000 psig, a liquid hourly space velocity of 0.1 to 5.0 per hour and a hydrogen circulation rate of 500 to 8000 SCF $H_2$/Bbl of charge.

A preferred hydrotreating catalyst is one that is effective in converting Conradson carbon precursors and has a high capacity for absorbing metals components from the hydrocarbon charge. Such catalysts are available from commercial suppliers and do not constitute a part of the invention. The hydrotreater reactor may be a fixed bed or an ebullated bed type. If the fresh feed has a high metals content, it may be desirable in a fixed bed operation to include an initial catalyst section in the hydrotreater which is particularly effective in adsorbing metals components. In some cases, a guard bed of partially spent or inexpensive catalyst may be placed upstream from the main body of hydrotreater catalyst to remove metals components and to protect the main catalyst bed.

The hydrotreater effluent is passed to separator 40 and hot liquid recycle is combined with any fresh feed which was not initially hydrotreated and fed to cracking furnace 12. Hydrotreater gases are processed as indicated in the FIGURE, and recycle hydrogen along with make-up hydrogen as needed is compressed for use in the hydrotreater.

According to a particularly preferred embodiment of the invention, the entire pitch fraction from flash tower 20 is combined with recycle donor and recycled to extinction. In this embodiment, no pitch product is removed from the system, and the entire fresh feed is eventually converted to distillate.

Hydrotreater condensate, $C_5$-650° F. distillate, 650°–950° F. distillate and any pitch withdrawn from the process may be combined to form a low sulfur syncrude.

The process of the invention was demonstrated in two pilot plant runs. In one run, a vacuum resid from a low sulfur crude oil was fed to the process, and in the other run a high sulfur tar sand oil was used as fresh feed. In both runs, the pitch from the cracking furnace was recycled to extinction, providing a product mix of all 950° F.− material.

EXAMPLE 1

This example used the vacuum resid from a low sulfur crude oil as feed. All fresh feed was charged to the hydrotreater. Pilot plant operation was simplified by using once-through hydrogen. Yields and inspections of the feed and products are given in Table 1.

TABLE 1

| | Vacuum Resid | Distillate | Gas Make | Internal Stream Samples |
|---|---|---|---|---|
| Yield, Wt % | — | 83.3 | 10.6 | 6.1 |
| Vol % | — | 94.8 | — | 6.0 |
| Inspections | | | | |
| Gravity, °API | 12.8 | 32.6 | | |
| Total Sulfur, Wt % | 1.0 | 0.05 | | |
| Total Nitrogen, Wt % | 0.5 | 0.05 | | |
| Ni + V, ppm | 48 | 0 | | |
| Nonvolatiles (950° F.+), Wt % | 92 | 0 | | |
| Conradson Carbon Residue, Wt % | 13 | 0 | | |

Some streams from the cracking furnace feed and from the flash tower bottoms were withdrawn only for monitoring the process. All other pitch was recycled to extinction and cracked to 950° F.− products.

The cracking furnace ran at 517 psig outlet pressure, 681° F. inlet temperature, 968° F. outlet temperature, and 2.2 minutes cold-oil residence time. The hydrotreater reactor ran at 929 psig outlet pressure, an average temperature of 698° F., 7400 SCF hydrogen circulation per barrel of fresh feed, and 0.64 liquid hourly space velocity. Catalyst was a nickel-molybdenum hydrotreating catalyst.

EXAMPLE 2

A second pilot plant operation was run on a tar sand oil containing high concentrations of sulfur, nonvolatiles, and Conradson carbon precursors. Distillation of flash tower overhead vapors to obtain recycle donor was simulated by using a hydrotreated donor solvent to predilute the tar sand oil. This was done to reduce tar sand oil viscosity and to simplify pilot plant operations. All feed was charged to the hydrotreater. Hydrogen circulation was once-through. Yields and inspections of the feed and products are given in Table 2.

TABLE 2

| | Tar Sand Oil | Net Distillate | Gas Make | Internal Stream Samples |
|---|---|---|---|---|
| Yield, Wt % | — | 81.0 | 15.8 | 3.2 |
| Vol % | — | 92.5 | | 3.3 |
| Inspections | | | | |
| Gravity, °API | −2.0 | 16.3 | | |
| Total Sulfur, Wt % | 10.5 | 0.41 | | |
| Total Nitrogen, Wt % | 0.34 | 0.07 | | |
| Ni + V, ppm | 130 | 0 | | |
| Nonvolatiles (950° F.+), Wt % | 72 | 0 | | |
| Conradson Carbon Residue, Wt % | 24 | 0 | | |

Sample streams from the cracking furnace feed and from the flash tower bottoms were withdrawn for analysis. All other pitch was recycled to extinction and converted to 950° F.− products.

The cracking furnace ran at 500 psig outlet pressure, 686° F. inlet temperature, 947° F. outlet temperature, and 2.4 minutes coil-oil residence time. The hydrotreater ran at 900 psig outlet pressure, an average temperature of 703° F., 4300 SCF hydrogen circulation per barrel of tar sand oil, and 0.61 liquid hourly space velocity. Catalyst was a nickel-molybdenum hydrotreating catalyst.

The above examples demonstrate that heavy hydrocarbonaceous oils can be completely converted by a hydrogen donor diluent cracking process to distillate and light gases by catalytically hydrotreating the pitch fraction from the donor cracking step. Prior art processes describe recycle of this pitch fraction, but they do not suggest catalytic hydrotreating of the pitch to provide increased distillate yields.

The benefits of the process of the invention include an increased yield of dstillate from a hydrogen donor diluent cracking process. This results from catalytically hydrotreating at least part of the pitch fraction from the donor cracking step. Preferably, the entire pitch fraction is recycled to extinction, such that the entire fresh feed is eventually converted to light gases or distillates.

The foregoing description of the preferred embodiments is intended to be illustrative rather than limiting of the invention, which is defined by the appended claims.

We claim:

1. A process for converting heavy hydrocarbonaceous oil into lighter distilate products comprising:

(a) thermally cracking said oil in the presence of a hydrogen donor solvent to produce distillate products and residual pitch;

(b) recovering recycle donor solvent from said distillate products;

(c) catalytically hydrotreating said recycle donor solvent and at least a part of said residual pitch;

(d) combining hydrotreated recycle donor solvent and hydrotreated residual pitch with additional heavy hydrocarbonaceous oil; and (e) subjecting said combined materials to thermal cracking as in step (a).

2. The process of claim 1 wherein all of said residual pitch is catalytically hydrotreated.

3. The process of claim 1 wherein all of said residual pitch is recycled to extinction.

4. The process of claim 1 wherein at least a part of said heavy hydrocarbonaceous oil is catalytically hydrotreated prior to being thermally cracked.

5. The process of claim 4 wherein said residual pitch, said recycle donor solvent and said heavy hydrocarbonaceous oil are combined and catalytically hydrotreated prior to being thermally cracked.

6. The process of claim 4 wherein said at least a part of said heavy hydrocarbonaceous oil is first contacted with a hydrotreating catalyst capable of removing metals-containing components therefrom and then contacted with additional hydrotreating catalyst.

7. The process of claim 6 wherein all of said heavy hydrocarbonaceous oil is combined with all of said residual pitch and recycle donor solvent prior to being catalytically hydrotreated.

8. A process for converting heavy hydrocarbonaceous oil into lighter distillate products comprising:

(a) thermally cracking said oil in the presence of a hydrogen donor solvent at cracking conditions including a furnace outlet temperature of 850°–1000° F., a furnace outlet pressure of 400–700 psig and a cold oil residence time of one to six minutes to produce distillate products and residual pitch;

(b) recovering recycle donor solvent from said distillate products;

(c) catalytically hydrotreating said recycle donor solvent and at least a part of said residual pitch at a temperature of from 650°–800° F., a pressure of from 500 to 3000 psig, a liquid hourly space velocity of 0.1 to 5.0 per hour and a hydrogen circulation rate of 500 to 8000 SCF $H_2$/Bbl of charge;

(d) combining hydrotreated recycle donor solvent and hydrotreated residual pitch with additional heavy hydrocarbonaceous oil; and (e) subjecting said combined materials to thermal cracking as in step (a).

* * * * *